US008721294B2

(12) United States Patent
Watson

(10) Patent No.: US 8,721,294 B2
(45) Date of Patent: May 13, 2014

(54) AIRFOIL WITH GALVANICALLY ISOLATED METAL COATING

(75) Inventor: Thomas J. Watson, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 933 days.

(21) Appl. No.: 12/783,987

(22) Filed: May 20, 2010

(65) Prior Publication Data

US 2011/0286854 A1 Nov. 24, 2011

(51) Int. Cl.
*F01D 5/28* (2006.01)

(52) U.S. Cl.
USPC ..... 416/241 A; 416/241 R

(58) Field of Classification Search
USPC ..... 416/241 R, 241 A, 248; 427/250, 405, 427/372.2, 388.5; 428/650, 458, 621, 655; 72/53
See application file for complete search history.

(56) References Cited

U.S. PATENT DOCUMENTS

| | | | | |
|---|---|---|---|---|
| 2,776,253 | A * | 1/1957 | Scholl | 205/159 |
| 2,959,229 | A | 11/1960 | Meier | |
| 3,957,416 | A * | 5/1976 | Kaempen | 425/470 |
| 5,593,748 | A * | 1/1997 | Hubbard | 428/41.3 |
| 6,102,664 | A * | 8/2000 | Nguyen | 416/248 |
| 2004/0038068 | A1 | 2/2004 | Finch | |
| 2004/0066995 | A1 * | 4/2004 | Whitney | 384/276 |
| 2007/0190352 | A1 | 8/2007 | Bayer et al. | |
| 2008/0317602 | A1 * | 12/2008 | Deakin et al. | 416/241 R |

FOREIGN PATENT DOCUMENTS

| | | |
|---|---|---|
| GB | 684012 | 12/1952 |

OTHER PUBLICATIONS

"West System Use Guide—Epoxy Chemistry", Apr. 27, 2009, published by West System, a company in Bay City, MI, web20090427143140*/http://www.westsystem.com/ss/epoxy.*

* cited by examiner

*Primary Examiner* — Christopher Verdier
(74) *Attorney, Agent, or Firm* — Carlson, Gaskey & Olds, P.C.

(57) ABSTRACT

An airfoil component includes an aluminum alloy body having at least an airfoil portion and a root portion. A metallic layer is located on at least a portion of the aluminum alloy body and an electrochemically insulating layer is located between and adjoining the aluminum alloy body and the metallic layer.

24 Claims, 2 Drawing Sheets

AIRFOIL WITH GALVANICALLY ISOLATED METAL COATING

BACKGROUND

This disclosure relates to protective coatings or layers for airfoil components, such as those used in gas turbine engines.

Airfoils are commonly used in a gas turbine engines as fan blades, compressor blades, compressor vanes, or guide vanes. The airfoils are typically made of corrosion resistant materials, such as titanium alloys, to withstand the relatively harsh environment within the gas turbine engine. In particular, titanium alloys are attractive for use as blades and vanes because of resistance to many different conditions, such as corrosion, erosion, foreign object impact, wear resistance, and galling.

SUMMARY

An exemplary airfoil component includes an aluminum alloy body having at least an airfoil portion and a root portion. A metallic layer is located on at least a portion of the aluminum alloy body and an electrochemically insulating layer is located between and adjoins the aluminum alloy body and the metallic layer. The airfoil component may be a fan blade, compressor blade, compressor vane, or guide vane of a gas turbine engine.

An example method for use with an airfoil component includes galvanically separating an aluminum alloy body having at least an airfoil portion and a root portion from a metallic layer on at least a portion of the aluminum body with an electrochemically insulating layer located between and adjoining the aluminum alloy body and the metallic layer.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
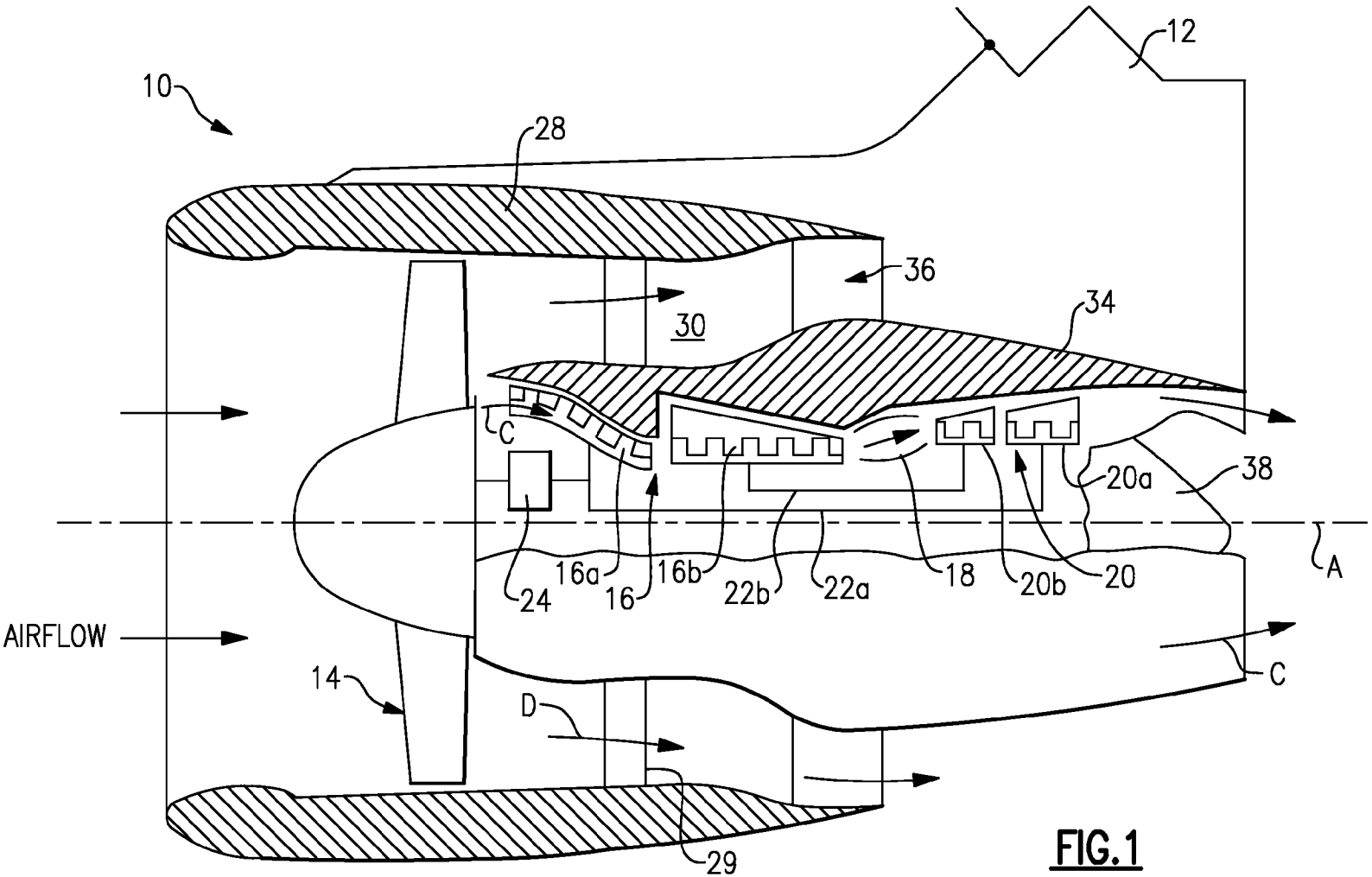
FIG. 1 illustrates an example gas turbine engine.

FIG. 1 illustrates a schematic view of selected portions of an example gas turbine engine 10 suspended from an engine pylon 12 of an aircraft, as is typical of an aircraft designed for subsonic operation. The gas turbine engine 10 is circumferentially disposed about an engine centerline, or axial centerline axis A. The gas turbine engine 10 includes a fan 14, a compressor 16 having a low pressure compressor section 16*a* and a high pressure compressor section 16*b*, a combustion section 18, and a turbine 20 having a high pressure turbine section 20*b* and a low pressure turbine section 20*a*. As is known, air compressed in the compressors 16*a*, 16*b* is mixed with fuel that is burned in the combustion section 18 and expanded in the turbines 20*a* and 20*b*. The turbines 20*a* and 20*b* are coupled for rotation with, respectively, rotors 22*a* and 22*b* (e.g., spools) to rotationally drive the compressors 16*a*, 16*b* and the fan 14 in response to the expansion. In this example, the rotor 22*a* drives the fan 14 through a gear train 24.

In the example shown, the gas turbine engine 10 is a high bypass geared turbofan arrangement. In one example, the bypass ratio is greater than 10:1, and the fan 14 diameter is substantially larger than the diameter of the low pressure compressor 16*a* and the low pressure turbine 20*a* has a pressure ratio that is greater than 5:1. The gear train 24 can be any known suitable gear system, such as a planetary gear system with orbiting planet gears, planetary system with non-orbiting planet gears, or other type of gear system. In the disclosed example, the gear train 24 has a constant gear ratio. Given this description, one of ordinary skill in the art will recognize that the above parameters are only exemplary and that the disclosed examples are applicable to other engine arrangements or other types of gas turbine engines.

An outer housing, nacelle 28, (also commonly referred to as a fan nacelle) extends circumferentially about the fan 14. A generally annular fan bypass passage 30 extends between the nacelle 28 and an inner housing, inner cowl 34, which generally surrounds the compressors 16*a*, 16*b* and turbines 20*a*, 20*b*. The gas turbine engine 10 also includes guide vanes 29 (shown schematically).

In operation, the fan 14 draws air into the gas turbine engine 10 as a core flow, C, and into the bypass passage 30 as a bypass air flow, D. In one example, approximately 80 percent of the airflow entering the nacelle 28 becomes bypass airflow D. A rear exhaust 36 discharges the bypass air flow D from the gas turbine engine 10. The core flow C is discharged from a passage between the inner cowl 34 and a tail cone 38. A significant amount of thrust may be provided by the bypass airflow D due to the high bypass ratio.

As can be appreciated, the gas turbine engine 10 may include airfoil components in one or more of the sections of the engine. As will be described below, the airfoil components generally include an airfoil portion and a root portion for mounting the airfoil component in the gas turbine engine 10. The fan blades, the low pressure compressor 16*a* and the high pressure compressor 16*b* blades and vanes, and the guide vanes 29 may be considered to be airfoil components. The airfoil portion of these components has a wing-like shape that provides a lift force via Bernoulli's principle such that one side of the airfoil is a suction side and the other side of the airfoil is a pressure side.

Figure 2:
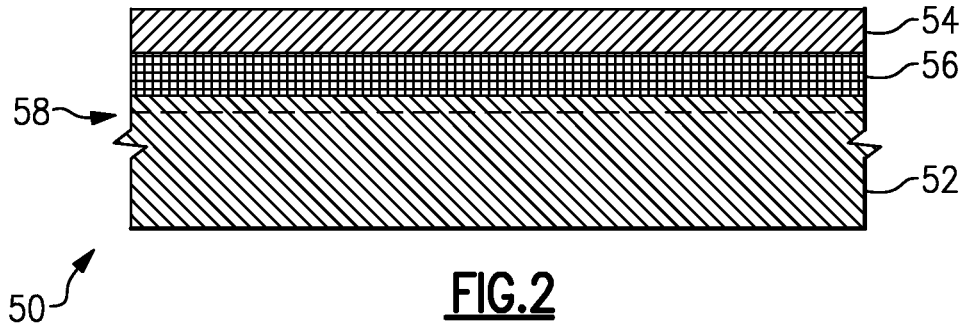
FIG. 2 illustrates a portion of an airfoil component.

FIG. 2 illustrates a portion of a structure of an airfoil component 50 that may be used for the fan blades, compressor blades and vanes, and the guide vanes 29. In this example, the airfoil component 50 includes an aluminum alloy body 52 and a metallic layer 54 located on at least a portion of the aluminum alloy body 52. Although only a portion of the aluminum body 52 is shown, the aluminum body 52 substantially forms the shape of the airfoil portion and the root portion of the component. An electrochemically insulating layer 56 is located between and adjoins the aluminum alloy body 52 and the metallic layer 54. That is, the electrochemically insulating layer 56 is directly adjacent to the aluminum alloy body 52 and the metallic layer 54.

The aluminum alloy body 52 is less resistant to corrosion, erosion, or the like in comparison to titanium alloy that has been used for airfoil components in the past. Thus, the metallic layer 54 is used as a protective layer on the aluminum alloy body 52 to resist corrosion, erosion, etc.

The metallic layer 54 includes chromium, nickel, cobalt, or combinations thereof. In some examples, these elements may be the major constituent element of an alloy that serves as the metallic layer 54. In other examples, these elements may be unalloyed such that the metallic layer 54 is substantially homogenous except for any impurities. Alternatively, the metallic layer 54 may be or may include other metallic elements that resist corrosion, erosion, etc. relative to the aluminum alloy body 52.

The different metals of the aluminum alloy body 52 and the metallic layer 54 create a galvanic potential difference. Such a difference can, under corrosive conditions, lead to accelerated corrosion of the less noble aluminum alloy body 52. The electrochemically insulating layer 56 galvanically separates the metallic layer 54 and the aluminum alloy body 52 to facilitate reducing or eliminating galvanic corrosion.

As an example, the electrochemically insulating layer 56 is generally an electrically insulating material, such as a polymeric material. In some examples, the polymer may be a thermosetting polymer, such as epoxy. In further examples, the electrochemically insulating layer 56 may be a fiber reinforced polymer, such as an epoxy matrix having continuous or discontinuous fiber reinforcement. The fibers may be provided as a scrim of continuous woven fibers. The fibers may be polymer fibers, such as polyamide, or inorganic, electrically insulating fibers, such as glass fibers.

In some examples, the aluminum alloy body 52 may include a peened surface 58 that facilitates improving strength and durability of the airfoil component 50. For instance, a peened surface may be a region of residual compressive stress on the surface of the aluminum alloy body 52. In this case, the polymer of the electrochemically insulating layer 56 may be selected to maintain the compressive stress of the peened surface 58. That is, the polymer may be a type that cures at a temperature below 150° F. (66° F.) to facilitate maintaining the compressive residual stress. If the curing temperature is above 150° F., the high temperature may relax the residual stress and thereby negate the peening.

Figure 3A:
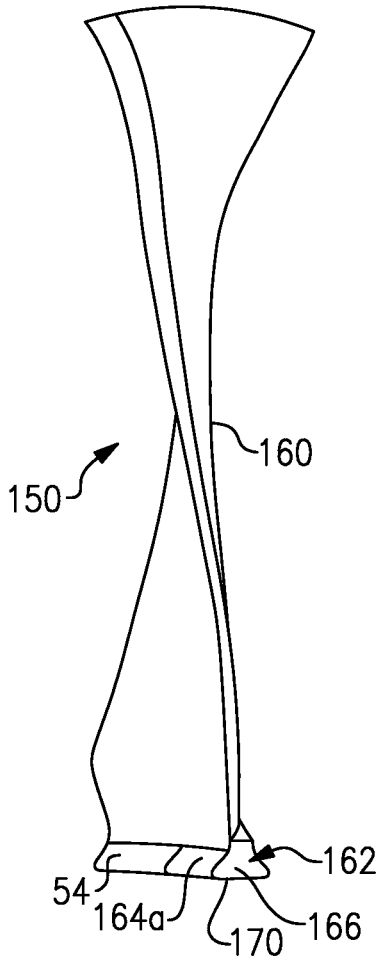
FIG. 3*a* illustrates a first view of a fan blade.
Figure 3B:
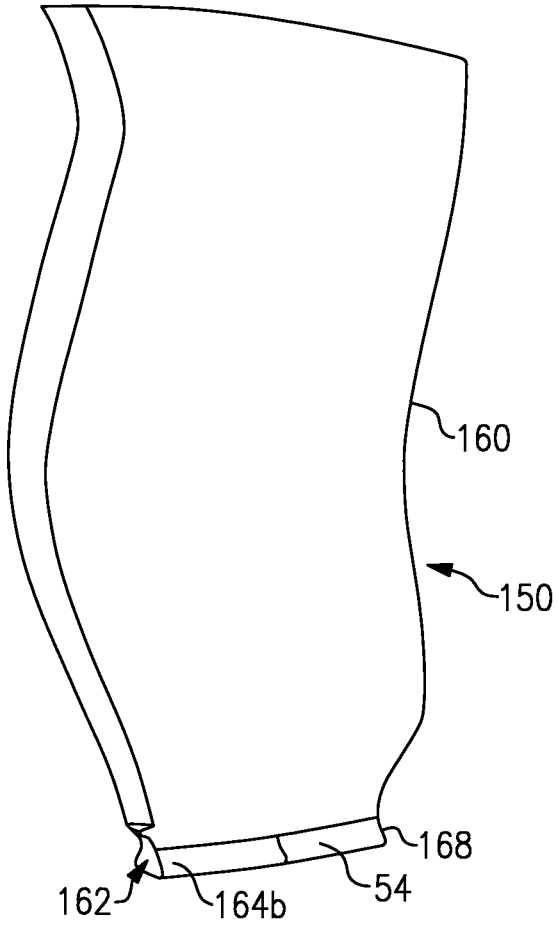
FIG. 3*b* illustrates another view of a fan blade.

FIGS. 3*a* and 3*b* illustrate the airfoil component 150. In this case, the airfoil component 150 is a fan blade that may be used in the fan 14 of the gas turbine engine 10. However, it is to be understood that the airfoil component may alternatively be a compressor blade or vane, or a guide vane. The fan blade includes an airfoil portion 160 and a root portion 162. In this case, since the fan rotates, the end opposite from the root portion 162 is a free end. Generally, the root portion 162 is shaped to mount the fan blade in the gas turbine engine 10. For instance, the root portion 162 includes (e.g., relative to the rotation of the fan 14 about the axis A and gas flow through the engine) circumferential sides 164*a* and164*b*, a forward side 166, a trailing side 168, and a radially inner side 170.

In this example, the metallic layer 54 and the electrochemically insulating layer 56 (not shown, under the metallic layer 56) may extend continuously across the circumferential sides 164*a*, 164*b* and the radially inner side 170. The remaining portions of the fan blade may be free from the metallic layer 54 and the electrochemically insulating 56. That is, the metallic layer 54 may be used only on the root portion 162 to protect the root portion 162 from wear against the mating structure, such as a hub. However, it is to be understood that in other examples, the metallic layer 54 and the electrochemically insulating layer 56 may be applied to other portions of the airfoil component, such as a leading edge of the airfoil portion 160 or the trailing edge of the airfoil portion 160.

The electrochemically insulating layer 56 and the metallic layer 54 may be applied onto the aluminum alloy body in any suitable manner. For instance, the electrochemically insulating layer 56 may be provided as a scrim that is secured to the aluminum alloy body 52 using a polymer (e.g., epoxy) adhesive that is then cured on the aluminum alloy body 52. The metallic layer 54 may then be deposited onto the outer surface of the electrochemically insulating layer 56. In some examples, the adhesion between the metallic layer 54, the electrochemically insulating layer 56, and the aluminum alloy body 52 may be relatively weak. However, the metallic layer 54 conforms to the geometry of the root portion 162 or other portion of the airfoil component and thereby mechanically locks onto the component.

Alternatively, the metallic layer 54 and electrochemically insulating layer 56 may be provided as a separate, pre-fabricated piece that is then assembled onto the root portion or other portion of the aluminum alloy body 52.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An airfoil component comprising:

an aluminum alloy body comprising at least an airfoil portion and a root portion;

a metallic layer on at least a portion of the aluminum alloy body; and an electrochemically insulating layer located between and adjoining the aluminum alloy body and the metallic layer such that the electrochemically insulating layer is in direct contact with the aluminum alloy body and the metallic layer.

2. The airfoil component as recited in claim 1, wherein the metallic layer is selected from a group consisting of chromium, nickel, cobalt, and combinations thereof.

3. The airfoil component as recited in claim 1, wherein the metallic layer comprises nickel.

4. The airfoil component as recited in claim 1, wherein the metallic layer comprises cobalt.

5. The airfoil component as recited in claim 1, wherein the metallic layer comprises chromium.

6. The airfoil component as recited in claim 1, wherein the metallic layer and the electrochemically insulating layer are located on the root portion of the aluminum alloy body and the airfoil portion is free of the metallic layer and the electrochemically insulating layer.

7. The airfoil component as recited in claim 1, wherein the electrochemically insulating layer comprises a polymer.

8. The airfoil component as recited in claim 1, wherein the electrochemically insulating layer comprises epoxy.

9. The airfoil component as recited in claim 1, wherein the electrochemically insulating layer comprises a fiber reinforced polymer.

10. The airfoil component as recited in claim 1, wherein the electrochemically insulating layer comprises a fiber reinforced polymer having nylon fibers.

11. The airfoil component as recited in claim 1, wherein the electrochemically insulating layer comprises a fiber reinforced polymer having glass fibers.

12. The airfoil component as recited in claim 1, wherein the electrochemically insulating layer comprises a thermosetting polymer that cures at a temperature below 150° F. (66° C.).

13. The airfoil component as recited in claim 1, wherein the aluminum alloy body includes a peened surface and the electrochemically insulating layer comprises a polymer that cures at a temperature below 150° F. (66° C.).

14. The airfoil component as recited in claim 1, wherein the root portion extends between circumferential sides, a leading side, a trailing side and a radially inner side, and the metallic layer is a continuous coating on at least the circumferential sides and the radially inner side.

15. A gas turbine engine comprising:

an airfoil component having an aluminum alloy body comprising at least an airfoil portion and a root portion, a metallic layer on at least a portion of the aluminum body, and an electrochemically insulating layer located between and adjoining the aluminum alloy body and the metallic layer.

16. The gas turbine engine as recited in claim 15, wherein the airfoil component is a fan blade.

17. The gas turbine engine as recited in claim 15, wherein the airfoil component is a compressor blade or vane.

18. The gas turbine engine as recited in claim 15, wherein the airfoil component is a guide vane.

19. A method for use with an airfoil component, the method comprising:

galvanically separating an aluminum alloy body comprising at least an airfoil portion and a root portion from a metallic layer on at least a portion of the aluminum alloy body with an electrochemically insulating layer located between and adjoining the aluminum alloy body and the metallic layer, the electrochemically insulating layer being in direct contact with the aluminum alloy body and the metallic layer.

20. The airfoil component as recited in claim 1, wherein the electrochemically insulating layer is an electrically insulating material that galvanically separates the metallic layer and the aluminum alloy body.

21. The airfoil component as recited in claim 1, wherein the electrochemically insulating layer includes woven fibers.

22. The airfoil component as recited in claim 1, wherein the electrochemically insulating layer extends continuously on the aluminum alloy body.

23. The airfoil component as recited in claim 1, wherein the metallic layer is selected from a group consisting of chromium, nickel, cobalt, and combinations thereof, the electrochemically insulating layer comprises a polymer, and the metallic layer and the electrochemically insulating layer are located on the root portion of the aluminum alloy body and the airfoil portion is free of the metallic layer and the electrochemically insulating layer.

24. The gas turbine engine as recited in claim 15, wherein the electrochemically insulating layer is an electrically insulating layer in direct contact with the aluminum alloy body and the metallic layer.

* * * * *